United States Patent [19]

Sasso

[11] Patent Number: 4,591,146

[45] Date of Patent: May 27, 1986

[54] CONTINUOUS FEED DOCUMENT CARRIER

[76] Inventor: Bill J. Sasso, 8222 Furlong, Houston, Tex. 77071

[21] Appl. No.: 687,473

[22] Filed: Dec. 28, 1984

[51] Int. Cl.[4] ..... B65H 5/02

[52] U.S. Cl. ..... 271/275; 271/204; 198/846; 282/11.5 A

[58] Field of Search ..... 271/275, 277, 204; 282/11.5 A, 11.5; 198/844, 846

[56] References Cited

U.S. PATENT DOCUMENTS

| | | | |
|---|---|---|---|
| 2,873,501 | 2/1959 | Renner | 198/844 X |
| 3,262,549 | 7/1966 | Stewart | 198/846 X |
| 4,170,281 | 10/1979 | Lapeyre | 198/844 |
| 4,487,645 | 12/1984 | Weston | 271/275 X |

*Primary Examiner*—Richard A. Schacher
*Attorney, Agent, or Firm*—Gunn, Lee & Jackson

[57] ABSTRACT

In the preferred and illustrated embodiment, a continuous feed document carrier is disclosed comprising a flexible conveyor member provided with a locking mechanism for connecting the ends of the conveyor member to form an endless loop conveyor. The conveyor member includes pockets located thereon for receiving an end portion of a document carried on the conveyor member. The pockets position and align the document on the conveyor member. The conveyor member includes perforations extending adjacent the longitudinal edges of the conveyor member so that the conveyor member may be pulled through a printer.

9 Claims, 6 Drawing Figures

CONTINUOUS FEED DOCUMENT CARRIER

BACKGROUND OF THE DISCLOSURE

This invention relates to document carriers, particularly, a continuous feed document carrier forming an endless loop conveyor for use with a continuous feed printer.

Continuous feed printers and printers with tractor feed attachments are in wide circulation and use. Continuous feed paper is almost exclusively used with these printers. The paper is generally stacked on the floor or in a carrier adjacent the printer and in alignment therewith so that the paper may be drawn through the printer without binding. Continuous feed paper is generally blank without notations printed thereon. Custom printing on continuous feed paper is also available. However, use of continuous feed paper is not desired for some purposes because it is generally of a lesser quality than letterhead bond paper. Letterhead paper is generally preferred for most correspondence. Cut sheet feeders are available to feed letterhead paper through a printer. Cut sheet feeders, however, are very expensive and subject to jamming, particularly if not properly loaded.

The apparatus of the present disclosure permits a user to print on letterhead paper using a continuous feed printer. This is accomplished by providing a continuous feed document carrier which forms an endless loop conveyor through the printer. The letterhead paper is positioned on the document carrier which feeds the letterhead paper through the printer. In this manner, a user can print on letterhead paper continuously without stopping the printer at the end of each page to insert another page. The apparatus of the invention is particularly useful when multiple original copies of a document are required. However, the apparatus is not limited to this particular function. It may be utilized to continuously feed cut sheet paper of any type through a printer, thus, eliminating the need and expense of a cut sheet feeder.

SUMMARY OF THE DISCLOSURE

The present disclosure is directed to a continuous feed document carrier comprising a flexible conveyor member forming an endless loop conveyor. The conveyor member includes a plurality of pockets thereon for positioning and securing documents on the conveyor member. Perforations are formed along the longitudinal edges of the conveyor member for pulling the conveying member through a printer.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
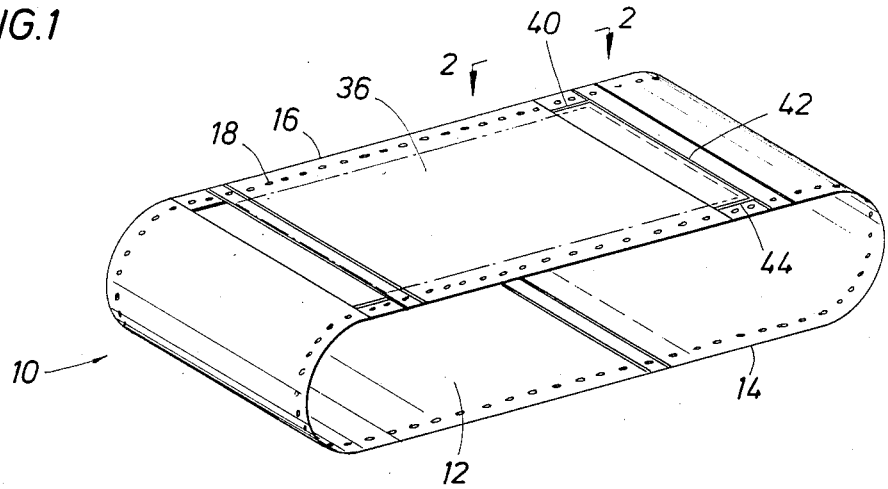
FIG. 1 is a perspective pictoral view of the apparatus of the invention.

Attention is first directed to FIG. 1 which is a perspective pictoral view of the apparatus of the invention. The apparatus is generally identified by the reference numeral 10. The apparatus 10 comprises a flexible conveyor member 12 having its ends joined together to form an endless loop conveyor of a specified length. The conveyor member 12 may be fabricated from a variety of flexible materials, however, orange calendered rigid vinyl is preferred because of its resistance to cracking and creasing. The conveyor member 12 is perforated along its longitudinal edges 14 and 16. The perforations 18 are sized and spaced to receive the teeth of the tractor feed mechanism on a printer. The spacing between the perforations 18 corresponds to the spacing between the teeth on the tractor feed mechanism so that the conveyor member 12 is smoothly and continuously pulled through the printer.

Figure 4:
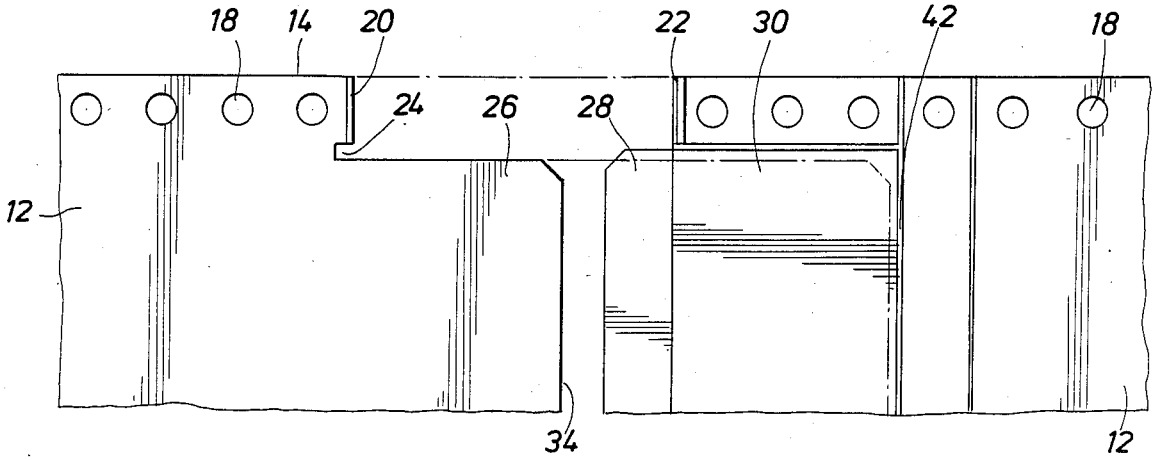
FIG. 4 is an enlarged partial view showing the locking mechanism of the apparatus of the invention.

Referring now to FIG. 4, the interlocking relationship between the ends of the conveyor member 12 is shown. The locking mechanism of the apparatus 10 is a bead and groove arrangement which easily snaps together to lock the ends of the conveyor member 12. The bead 20 and mating groove 22 cooperate to lock the ends of the conveyor member 12. The bead 20 and groove 22 are approximately ½ inch in length and located in the margin of the conveyor member 12 and extend inwardly from the edge 14. Both edges 14 and 16 have similar construction. A notch 24 separates the bead 20 from an extension 26 projecting a short distance from the end of the conveyor member 12. In this manner, freedom of movement is provided to the bead 20 so that it may be easily locked in the groove 22. Separation of the bead 20 from the extension 26 reduces lateral stress at the point of joinder of the bead 20 and groove 22.

The extension 26 aids the user of the apparatus 10 to quickly and easily bring the ends of the conveyor member 12 into locking engagement. To bring the two ends together, the extension 26 is placed over the flap 28 extending from the opposite end of the conveyor member 12 and slides into the pocket defined by the flap 28 and an overlapping parallel member 30. The extension 26 extends into the pocket and penetrates to abut against a seam 32 defining the end of the pocket. The pocket substantially conforms to the size and shape of the extension 26 so that when the edge 34 of the extension 26 abuts the seam 32, the bead 20 and groove 22 are aligned and may be easily snapped together to lock the ends of the conveyor 12, thus forming the endless loop conveyor. Bead alignment with the groove 22 is assisted by pocket depth and extension 26 length.

Figure 2:
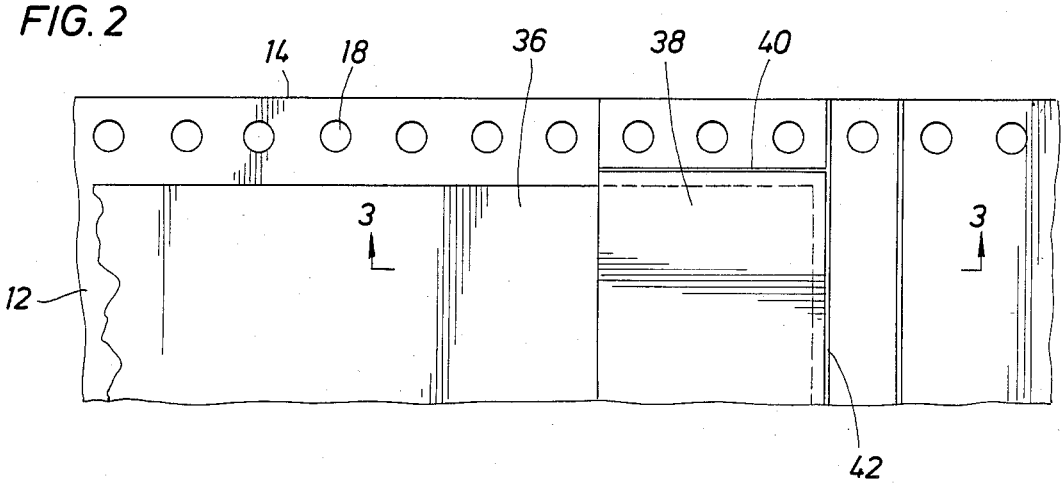
FIG. 2 is an enlarged partial view of the apparatus of the invention taken along line 2—2 of FIG. 1.
Figure 3:
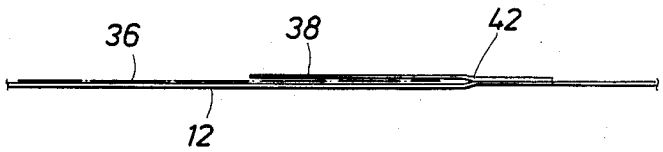
FIG. 3 is a sectional view taken along 3—3 of FIG. 2.

Referring again to FIG. 1, the apparatus 10 is shown joined together to form the endless loop conveyor. A document or letterhead sheet 36 is positioned on the conveyor member 12. One end of the sheet 36 is received in a pocket defined by the surface of the conveyor member 12 and an overlapping cover 38. The cover 38 is attached to the conveyor member 12 along seams 40, 42, and 44 defining the inner dimensions of the pocket. When the sheet 36 is positioned on the conveyor member 12 as shown in FIG. 2, the cover 38 extends over the sheet 36 a sufficient distance, approximately one and one quarter inches, to cover the letterhead and press the sheet 36 against the conveyor member 12. The sheet 36 is positioned on the conveyor member 12 so that its uppermost edge abuts against the seam 42 of the pocket. The pocket properly aligns the sheet 36 on the conveyor member 12 so that the printer will print on the exposed surface of the sheet 36 as the conveyor member 12 is pulled through the printer. Pocket size conforming to the upper end of the sheet 36 registers the sheet.

In the preferred and illustrated embodiment in FIG. 1, the conveyor member 12, for illustrative purposes only, comprises three segments of a specified length; a segment of the conveyor member 12 being defined as the length of the conveyor member 12 between the seams 42. It is understood, however, that the conveyor member 12 may be any desired length of N segments where N is an integer. If the length of the conveyor member 12 is substantially longer, perhaps ten feet or more, it may be desireable to fold the conveyor member 12 to form a stack of N segments, rather than connect the ends of the conveyor belt to form an endless loop conveyor. The length of each segment of N segments is equal to the length of the letterhead sheet 36 carried on the conveyor member. Thus, for eleven inch letterhead paper, the length of each segment is eleven inches. The length of the endless loop conveyor would then be eleven times N; if N were ten, the length of the endless loop conveyor would be one hundred ten inches. Uniform coveyor segments aid automatic use of the apparatus 10.

Figure 5:
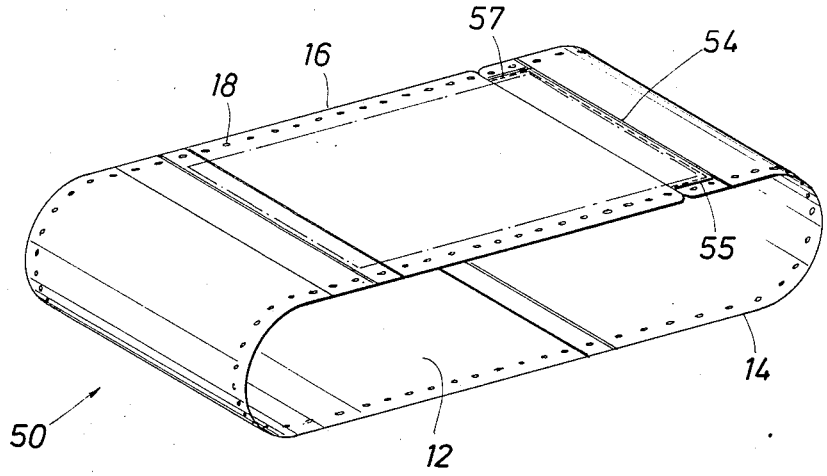
FIG. 5 is a perspective pictoral view of an alternate embodiment of the invention.
Figure 6:
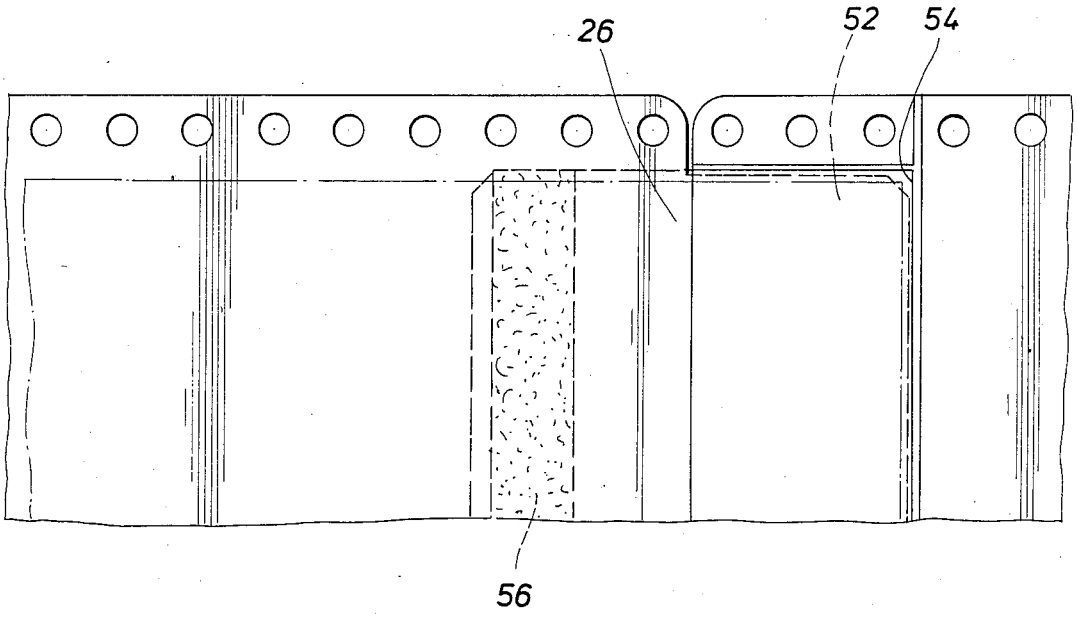
FIG. 6 is an enlarged partial view showing the locking mechanism of the alternate embodiment of the invention.

Referring now to FIGS. 5 and 6, an alternate embodiment of the invention is disclosed. The apparatus 50 of the alternate embodiment is substantially identical in appearance and function to the apparatus 10 disclosed in FIGS. 1—4. The apparatus 50, however, employs an alternate connection means for connecting the ends of the conveyor members 12 to form the endless loop conveyer. In the alternate embodiment, the guide flap 52 extends from one end of a conveyor member 12 a sufficient distance to assist in guiding the extension 26 into the pocket, the depth of which is defined by seams 54, 55 and 57. While the length of the guide flap 52 may vary, in the alternate embodiment, the guide flap 52 substantially conforms to the length and width of the extension 26. A strip of adhesive 56 extends across the guide flap 52. In the assembled position shown in FIG. 1, the extension 26 extends into the pocket as previously described and the leading end thereof abuts against the seam 54. The guide flap 52 extends underneath the bottom surface of the conveyor member 12 and is adhesively attached thereto. The adhesive 56 is releasable so that the flap 52 may be conveniently peeled and detached from the bottom surface of the conveyor member 12 permitting separation of the ends thereof and the removal of the apparatus 50 from the printer.

The continuous feed document carrier of the invention does not interfere with the use of continuous feed paper with a printer in the customary manner. The document carrier of the invention may be fed through the printer simultaneously with the continuous feed paper functioning as a backing sheet for the paper.

While the foregoing is directed to the preferred embodiment of the present invention, other and further embodiments of the invention may be devised without departing from the basic scope thereof, and the scope thereof is determined by the claims which follow.

What is claimed is:

1. A continuous feed document carrier, comprising;

(a) a flexible conveyor member having cooperative connection means, said conveyor member forming an endless loop conveyor upon locking said connection means;

(b) pocket means located on said conveyor member for receiving an end portion of a document therein, said pocket means including a registration edge defining the depth of said pocket means for abutment with the end of the document received therein for positioning and aligning the document on said conveyor member for subsequent printing thereon;

(c) alignment means for guiding said connection means into locking engagement to form said endless loop conveyor, said alignment means comprising an extension extending from one end of said conveyor member, said extension including a leading edge for abutment with said registration edge and having a length substantially equal to the depth of said pocket means; and (d) traction means extending adjacent the longitudinal edge of said conveyor member to enable pulling said conveyor member through a printer.

2. The apparatus of claim 1 wherein said pocket means is formed by said conveyor member and an overlapping cover attached thereon.

3. The apparatus of claim 1 wherein said traction means comprises perforations extending along two parallel edges of said conveyor member, said perforations being sized and spaced for cooperative engagement with a tractor feed mechanism on a printer.

4. The apparatus of claim 1 wherein said conveyor member comprises N segments, where N is an integer.

5. The apparatus of claim 4 wherein the length of each of said N segments is substantially equal, said length being substantially equal to the length of the document positioned thereon.

6. The apparatus of claim 1 wherein said connection means comprises separable bead and groove locking mechanisms, said bead and groove being aligned for locking engagement upon abutment of said leading edge of said extension with said registration edge in said pocket means.

7. The apparatus of claim 1 wherein said alignment means comprises an extension member extending from each end of said conveyor member, one of said extension members overlying the other of said extension members and including a leading edge for abutment with said registration edge defining the depth of said pocket means.

8. The apparatus of claim 7 wherein one of said extension members includes a strip of adhesive thereon for adhesively attaching said extension member to said conveyor member forming an endless loop conveyor.

9. The apparatus of claim 7 wherein said extension members are substantially identical in length and width.

* * * * *